US011913127B2

(12) United States Patent
Neumann et al.

(10) Patent No.: US 11,913,127 B2
(45) Date of Patent: Feb. 27, 2024

(54) METHOD FOR ELECTRO-DICARBOXYLATION OF AT LEAST ONE ALKENE WITH CARBON DIOXIDE $CO_2$ IN THE PRESENCE OF HYDROGEN $H_2$

(71) Applicant: TECHNISCHE UNIVERSITÄT BERLIN, Berlin (DE)

(72) Inventors: Maximilian Neumann, Berlin (DE); Reinhard Schomäcker, Berlin (DE); Peter Strasser, Berlin (DE)

(73) Assignee: TECHNISCHE UNIVERSITÄT BERLIN, Berlin (DE)

( * ) Notice: Subject to any disclaimer, the term of this patent is extended or adjusted under 35 U.S.C. 154(b) by 0 days.

(21) Appl. No.: 17/626,046

(22) PCT Filed: Jul. 10, 2020

(86) PCT No.: PCT/EP2020/069587
§ 371 (c)(1),
(2) Date: Jan. 10, 2022

(87) PCT Pub. No.: WO2021/005216
PCT Pub. Date: Jan. 14, 2021

(65) Prior Publication Data

US 2022/0251717 A1 Aug. 11, 2022

(30) Foreign Application Priority Data

Jul. 10, 2019 (EP) ..... 19185462

(51) Int. Cl.

| | |
|---|---|
| ***C25B 3/07*** | (2021.01) |
| ***C25B 3/26*** | (2021.01) |
| ***C25B 3/29*** | (2021.01) |
| ***C25B 9/19*** | (2021.01) |
| ***C25B 11/02*** | (2021.01) |

(52) U.S. Cl.
CPC ..... *C25B 3/26* (2021.01); *C25B 3/07* (2021.01); *C25B 3/29* (2021.01); *C25B 9/19* (2021.01); *C25B 11/02* (2013.01)

(58) Field of Classification Search
CPC ..... C25B 3/07; C25B 3/26
(Continued)

(56) References Cited

U.S. PATENT DOCUMENTS 3,032,489 A * 5/1962 Loveland ..... C25B 3/25 562/595
3,778,466 A 12/1973 Matsuda et al.
(Continued)

FOREIGN PATENT DOCUMENTS

CN 101691664 A * 4/2010 ..... C25B 3/00
GB 2069533 A * 8/1981 ..... C25B 3/105

OTHER PUBLICATIONS

Grinberg et al., "Electrochemical Reduction of CO2 in the Presence of 1,3-Butadiene Using a Hydrogen Anode in a Nonaqueous Medium," Russian Chemical Bulletin (Feb. 1999), vol. 48, pp. 294-299. (Year: 1999).*

(Continued)

*Primary Examiner* — Edna Wong
(74) *Attorney, Agent, or Firm* — Maschoff Brennan

(57) ABSTRACT

The person invention relates to a method for the electro-decarboxylation of at least one diene with carbon dioxide $CO_2$ in the presence of hydrogen $H_2$, forming at least one unsaturated dicarboxylic acid, wherein the reaction is carried out in a reactor comprising at least one cathode as the working electrode for the cathodic activation of $CO_2$, at least one anode as the counterelectrode for the anodic oxidation of $H_2$, with a volumetric ration of hydrogen $H_2$ to carbon dioxide $CO_2$ between 1:1 and 1:3, a total pressure pg in the reactor between 2 and 4 MPa, particularly preferably
(Continued)

between 3 and 4 MPa, and an average current density j between 5 and 15 mA/cm$^2$, particularly preferably between 10 and 12.5 mA/cm$^2$.

18 Claims, 1 Drawing Sheet

(58) Field of Classification Search
USPC ..... 205/440
See application file for complete search history.

(56) References Cited

U.S. PATENT DOCUMENTS

| | | | |
|---|---|---|---|
| 3,864,225 | A | 2/1975 | Tyssee |
| 3,876,695 | A | 4/1975 | Von Kutepow |
| 4,377,451 | A | 3/1983 | van Tilborg et al. |
| 4,552,976 | A | 11/1985 | Lin et al. |
| 7,799,545 | B2 | 9/2010 | Burgard et al. |

OTHER PUBLICATIONS

Li et al., "Highly Regioselective Electrochemical Synthesis of Dioic Acids from Dienes and Carbon Dioxide," Electrochimica Acta (Jan. 1, 2011), vol. 56, No. 3, pp. 1529-1534. (Year: 2011).*

Matthessen et al., "Electrocarboxylation: Towards Sustainable and Efficient Synthesis of Valuable Carboxylic Acids," Beilstein Journal of Organic Chemistry (Oct. 27, 2014), vol. 10, No. 1, pp. 2484-2500. (Year: 2014).*

Roman Matthessen et al., "Electrocarboxylation: towards sustainable and efficient synthesis of valuable carboxylic acids" Beilstein Journal of Organic Chemistry, vol. 10, Oct. 10, 2014, pp. 2484-2500.

V.A. Grinberg et al., "Electrochemical reduction of CO2 in the presence of 1,3-butadiene using a hydrogen anode in a nonaqueous medium" Russian Chemical Bulletin, US, vol. 48, No. 2, Feb. 1, 1999, pp. 294-299.

Bringmann, J. and Dinjus, E. "Electrochemical synthesis of carboxylic acids from alkenes using various nickel-organic mediators: CO2 as C 1-synthon." Appl. Organom et al. Chern. 15 (Feb. 2001) 135-140.

Hwang, K.C. and Sagadevan, A. "One-pot room-temperature conversion of cyclohexane to adipic acid by ozone and UV light." Science 346/6216 (Nov. 14, 2014) 1495-1498.

Li, C.H. et al. "Highly regioselective electrochemical synthesis of dioic acids from dienes and carbon dioxide." Electrochimica Acta 56 (Jan. 2011) 1529-1534.

Matthessen, R. et al. "Paired Electrosynthesis of Diacid and Diol Precursors Using Dienes and CO2 as the Carbon Source." ChemElectroChem 2 (2015) 73-76. Nov. 6, 2014.

* cited by examiner

METHOD FOR ELECTRO-DICARBOXYLATION OF AT LEAST ONE ALKENE WITH CARBON DIOXIDE $CO_2$ IN THE PRESENCE OF HYDROGEN $H_2$

The present invention relates to a process for the electrodicarboxylation of at least one alkene, more particularly at least one diene, with carbon dioxide $CO_2$ in the presence of hydrogen $H_2$ and to a reactor for performing such a process.

DESCRIPTION

Among its other uses, adipic acid is a starting material for the large-scale production of polyamide 6.6 (nylon), and the acid is prepared industrially via the partial oxidation of "KA oil" in an annual order of magnitude of 2.5 million metric tons. Nitrous oxide, an unavoidable byproduct of production of the acid, is a greenhouse gas, with 298 times the greenhouse potential of $CO_2$. Moreover, the process requires the stoichiometric use of nitric acid, whose production is based for example on the energy-intensive Ostwald process. The KA oil for its part is prepared by the partial oxidation of cyclohexanone and cyclohexanol of fossil origin. One difficulty here lies in the pore conversion (4-11%) on a single pass through the reactor. There is a consequent need for recycling steps and for steps downstream of the production of adipic acid.

Alternative approaches include, in particular, the biotechnological and photocatalytic production of adipic acid (U.S. Pat. No. 7,799,545; Hwang, K. C., and Sagadevan, A. 2014, One-pot room-temperature conversion of cyclohexane to adipic acid by ozone and UV light. Science, 346, 1495-1498). There are also patents in existence concerning the production of adipic acid by double hydroesterification and dicarboxylation (U.S. Pat. Nos. 3,778,466, 4,552,976, 3,876,695).

A route to the production of adipic acid by way of electrochemical coupling of 1,3-butadiene with $CO_2$ (electrodicarboxylation) has already been presented by Loveland et al. (Electrolytic production of acyclic carboxylic acids from hydrocarbons, U.S. Pat. No. 3,032,489) and Tyssee et al. (Electrolytic carboxylation of substituted olefins, U.S. Pat. No. 3,864,225). Diverse illustrative parameter studies and also initial investigations in the macrokinetics of the reaction were subsequently carried out by Tilborg et al. (Electrochemical conversion of conjugated dienes into alkanedienedioic acids, U.S. Pat. No. 4,377,451). Building on this work, studies by Grinberg et al. (Electrochemical reduction of $CO_2$ in the presence of 1,3-butadiene using a hydrogen anode in a non-aqueous medium; Russian Chemical Bulletin, 1999, 48(2), 294-299) showed a feasibility, albeit limited, for the electrodicarboxylation with hydrogen. More recent studies by Li et al. (Electrochim. Acta 2011, 56, 1529-1534) have added to these investigations a complete production route to adipic acid without the use of hydrogen.

The electrochemical approach is represented in scheme 1 below:

Scheme 1

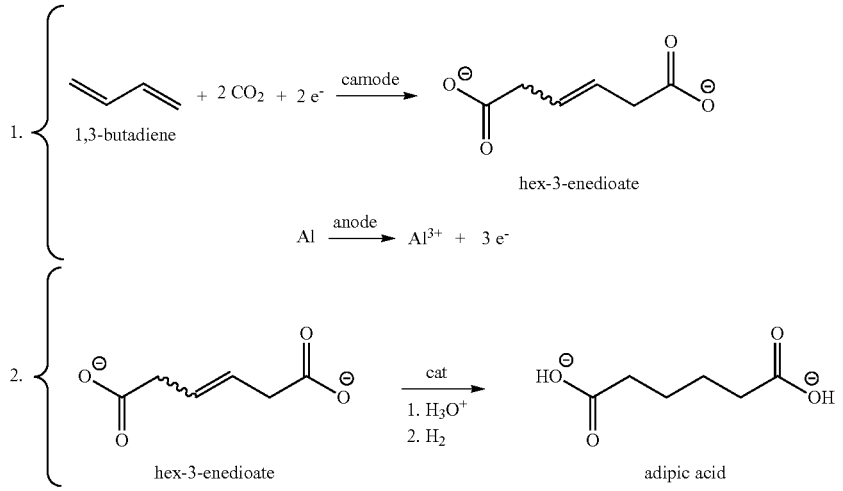

Besides the cathode at which the $CO_2$ reduction proceeds, a counter-re-action is required that releases the necessary electrons. This can be accomplished, for example, by a stack initial component, which for that purpose must be oxidized stoichiometrically. Sacrificial components or sacrificial materials used include, for example, aluminum, zinc or a redox system, which must either be reduced in a tandem process or subsequently separated off and recovered. Consequently the product phase after the reaction contains the target substance hex-3-enedioic acid (dihydromuconic acid) in the form of a sacrificial anode salt (product 1 in the scheme). It is extremely complicated and costly to split the product fraction or to develop a method for industrial realization for this process, and this difficulty stands in the way of industrial realization, and is attributable in particular to the sacrificial anode salt.

It is therefore desirable to avoid the formation of these salts in the product phase, and very lamely to avoid an associated, costly and inconvenient separation procedure. The object of the present invention, therefore, was to provide a process for the dicarboxylation of alkenes, mare particularly dienes, that avoids the stated drawbacks.

This object is achieved presently with a process and a reactor as described.

Provided accordingly is a process for the electrodicarboxylation of at least one diene with carbon dioxide $CO_2$ in the presence of hydrogen $H_2$ to form at least one unsaturated dicarboxylic acid, where the reaction is carried out in a reactor comprising at least one cathode as working electrode for the cathodic activation of $CO_2$, at least one anode as counterelectrode for the anodic oxidation of $H_2$ and optionally at least one reference electrode.

The present process is performed with

- a volumetric ratio of hydrogen $H_2$ to carbon dioxide $CO_2$ of 1:1 to 1:3;
- a total pressure $p_g$ in the reactor of between 2 and 4 MPa, preferably between 3 and 4 KPa; e.g., 3.4 MPa, 3.5 MPa, 3.7 MPa; and
- a mean current density j of between 5 and 15 mA/cm$^2$, preferably between 10 and 12.5 mA/cm$^2$.

With the present process there is optimization on the part of the anode, with the anode reaction (counter-reaction) used comprising hydrogen $H_2$, thereby allowing any industrial operation to be greatly simplified. Scheme 2 below summarizes the reaction, using the dicarboxylation of 1,3-butadiene as an example:

Scheme 2

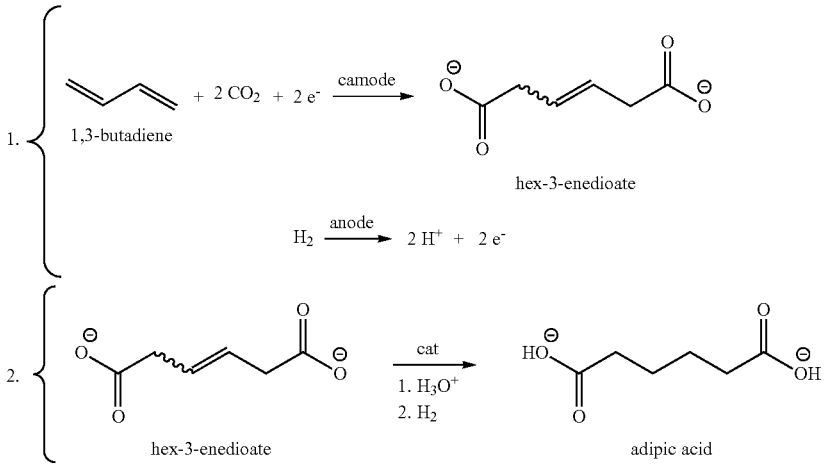

In the first step (labeled 1.) the $CO_2$ undergoes electrochemical cathodic activation. Proceeding simultaneously with this is the anode oxidation of $H_2$. The current circuit is then completed through the resultant protons, thereby achieving direct production of an unsaturated dicarboxylic acid, such as hex-3-enedioic acid, which is a precursor to adipic acid. Using electrochemically activated $CO_2$, therefore, two carboxyl groups (—$COO^-$) are introduced into an unsaturated alkene system.

Following the dicarboxylation, in one embodiment, the unsaturated dicarboxylic acid may be converted subsequently into the saturated dicarboxylic acid, such as, for example, the hex-3-enedioic acid into the target substance adipic acid, by means of a hydrogenation which is catalyzed either homogeneously or heterogeneously. For this purpose it is possible to use, alternatively, standard catalysts such as a platinum metal on activated carbon, silica or titanium dioxide, or else the very well-known Wilkinson catalyst, under suitable reaction conditions. It has emerged that first of all a removal of the electrolyte from the electrodicarboxylation (1.) is required for this purpose. The removal of the hydrogenation catalyst, the hydrogenation medium, and also the byproducts, where still present, from the dicarboxylation is then necessary in order to reach the adipic acid.

The present process has a variety of advantages over the existing approaches. There is no need, for instance, to use anodic sacrificial materials or sacrificial electrodes. This in turn means that the use of aluminum is avoided, as is the production of product aluminum salts which are difficult to purify, with the consequence of diverse cost savings in a corresponding process. The savings here relate to the nonuse of aluminum as a component with high specific costs, the avoidance of the process steps for the described splitting of the aluminum product salt, and also the avoidance of continual maintenance to the reactor, stemming from the replacement of spent sacrificial electrodes. The purification steps for an industrial operation under development are greatly simplified. There is also a greater conversion of the diene to the corresponding dicarboxylic acid, with a concurrent reduction in the formation of byproducts, particularly of monocarboxylic acids.

A particularly surprising finding is that an increase in pressure, especially in the $CO_2$ partial pressure, does not necessarily have a linear effect on the Faraday efficiency—that is, there is no linear relationship between pressure and Faraday efficiency. Instead, the $CO_2$ partial pressure in particular must be adjusted specifically. It has been found that not only very high (>4 MPa) but also low overall pressures (<2 MPa) have adverse impacts on the Faraday efficiency. The direct connection to models of reaction kinetics is not in evidence here. The dependencies are complex and they are neither directly predictable (by simulation, for example) nor amenable to forecasting and estimation if other input parameters are changed.

An increase in the overall pressure does not necessarily entail an increase in the Faraday efficiency. The equilibriums and dependencies here are complex, and to date are still not known. Increasing the pressure to 5 MPa, for example, with a ratio of 1:3 (hydrogen/carbon dioxide) leads to a sharp drop in the Faraday efficiency, to 15%.

Whereas Grinberg et al. (Electrochemical reduction of $CO_2$ in the presence of 1,3-butadiene using a hydrogen anode in a non-aqueous medium; Russian Chemical Bulletin, 1999, 48(2), 294-299) use gas diffusion electrodes (GDE) at only small superatmospheric pressures, the present process forgoes a GDE and increases the overall pressure. A gas mixture is employed. In addition, Grinberg et al. attain a relatively low Faraday efficiency.

In one embodiment of the present process, the hydrogen $H_2$ is present in the reactor with a partial pressure $p_{0,H2}$ of between 0.75 and 2 MPa, preferably between 1 and 1.5 MPa, especially preferably between 1.1 and 1.4 MPa, e.g., 1.25 MPa.

In another embodiment of the present process, the carbon dioxide $CO_2$ is present in the reactor with a partial pressure $p_{0,CO2}$ of between 2 and 4 MPa, especially preferably between 3 and 4 MPa, e.g., 3.75 MPa.

In yet a further embodiment of the present process, the at least one diene is metered in liquid form into the reactor. In this way, high diene concentrations in the reaction mixture are obtained. Accordingly the concentration of the metered diene may be 1-5 mol/l, preferably 1.5-3 mol/l, especially preferably 1.5-2 mol/l. Liquid diene, for example, may be introduced in a concentration of 1.62 mol/l into the reactor.

In the present context, a diene is a collective term for a group of compounds in which there are at least two double bonds in either conjugated or isolated form. Hence the at least one diene may be a linear conjugated diene, with linear conjugated dienes comprising, for example, 1,3-butadiene, pentadiene, hexadiene, 1,3,5-hexatriene, and cyclohexadiene.

It is also possible to use polyunsaturated, nonconjugated dienes. These dienes may comprise, for example, linear dienes having nonconjugated double bonds. Such dienes may have, for example, at least one terminal (end-positioned) double bond, examples being a, w-dienes such as 1,7-octadiene (OD), 1,9-decadiene, 1,11-dodecadiene, and 1,13-tetradecadiene.

The process parameters indicated for the present electrodicarboxylation enable an increase in the Faraday efficiency. The Faraday efficiency maps onto that fraction of the overall current, stoichiometrically, which goes to the desired products or byproducts—for example, "Faraday efficiency in respect of component X".

With the present process it is possible to achieve a Faraday efficiency $FE_{EC}$ for the sum total of all the dicarboxylation products which is between 10-55%, preferably 15-30%, especially preferably between 20-25%. The Faraday efficiency is dependent on the selected electro geometry, partial pressures and butadiene concentrations and on whether a mediator is employed, as elucidated in more detail later on below. A mediator here denotes a component, added additionally to the reaction, from the class of the metal-organic compounds, which may influence the Faraday efficiency in an unknown way.

The Faraday efficiency $FE_{EC}$ here for the sum total of all the dicarboxylation products which can be used for producing linear, unbranched dicarboxylic acids is between 5-30%, preferably between 10-25%, especially preferably between 15-20%, e.g., 13.3% or 26.2%.

In one embodiment of the present process, the reaction is performed in a dried organic solvent comprising at least one conductive salt. The organic solvent is selected from dimethylformamide (DMF); dimethylpropyleneurea (DMPU) and N-methyl-2-pyrrolidone (NMP); preference is given to using DMF. The at least one conductive salt is an alkylammonium bromide, preferably t-n-butylammonium bromide (TBAB).

In another preferred embodiment of the present process, the electrode dicarboxylation is performed in the presence of a mediator. The component referred to as a mediator is a metal-organic compound, such as a transition metal complex, for example. The effect on the reaction has surprisingly been confirmed, but was not foreseeable. Mediators generally speaking are frequently encountered in electrochemistry, but are highly specific to particular reactions and can be generalized for similar reactions only in rare cases.

The mediator is preferably a transition metal complex, more particularly an Rh, Pt, Pd, Ru or Fe complex. Particularly preferred mediators are platinum metal complexes with phosphane ligands (e.g., xanthphios) and ferrocene. The use of mediators leads to a reduction in the electropolymerization tendency and an increase in the Faraday efficiency. Any mediator applied preferably exhibits no catalyst function at all in the reaction itself, but may lower the macroscopic polymerization tendency of the 1,3-butadiene and influence the efficiency of the electrocarboxylation.

As already indicated above, the dicarboxylation may be followed by the reaction of the unsaturated dicarboxylic acid to form the saturated dicarboxylic acid. This may take place by means of a homogeneously or heterogeneously catalyzed hydrogenation, using known catalysts, such as platinum metal on a suitable support or a homogeneous catalyst complex, such as a platinum metal in the form of a metal-phosphine complex, the Wilkinson catalyst being one example, under suitable reaction conditions.

As mentioned above, the process is performed in a reactor which has at least one cathode as working electrode for the cathodic activation of $CO_2$, at least one anode as counter-electrode for the anodic oxidation of $H_2$, and at least one reference electrode.

In one variant of the reactor, anode and cathode are arranged parallel to one another.

In another variant of the present reactor, anode and cathode are arranged concentric to one another. In this variant, the anode is arranged concentrically around the cathode; in other words, the cathode may be arranged centrally, for example, in an annular anode and may consist, for example, of a narrow, polished nickel plate.

A concentric arrangement leads, surprisingly, to an increased electrocarboxylation selectivity of 73%, while a parallel arrangement leads to a selectivity of 44%. The values stated here for the electrocarboxylation selectivity are based on the partial quantity of the dicarboxylic acids relative to the amount of electrocarboxylation products generated overall.

The anode may consist of a platinum metal, an alloy of at least one platinum metal, or an extraneous metal support which is platinized or coated with platinum metal. Platinum has been used here preferably, and may take the form of a coil, a net, a woven fabric, immobilized platinum particles on a suitable support or a plate, such as a planar, flat or concentrically shaped plate, for example. The platinum anode material is very largely inert, and does not cause contamination of the system described.

The cathode consists of graphite, a transition metal, preferably a platinum metal, preferably of nickel, and may take the form of a flat plate. The cathode material is subjected preferably to a pretreatment involving consecutive steps of grinding, polishing, washing, and drying.

The anode and cathode space may be either divided (e.g., by a membrane) or, preferably undivided.

In another embodiment of the present reactor, the anode space and cathode space are separate from one another, by means more particularly of a membrane, made of Nafion, for example.

The invention is elucidated below with examples and with reference to the figures, in which

DESCRIPTION OF THE APPARATUS

Figure 1:
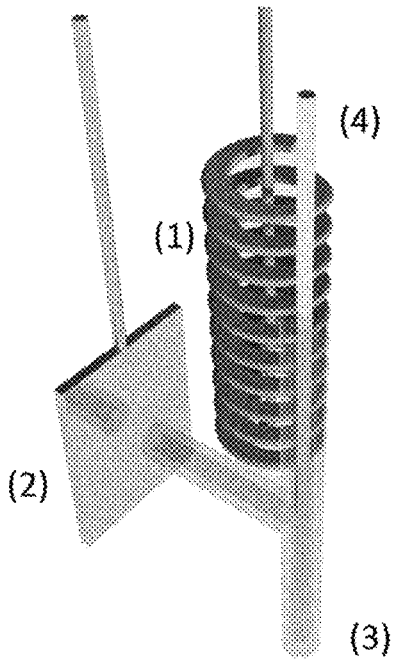
FIG. 1 shows a schematic view of a first embodiment of an electrode arrangement (parallel arrangement)

The apparatus arrangement used comprises a pressure-stable stirred tank with the electrode internals, a 1,3-butadiene metering system and a gas mixing system. The pressure-rated reactor used contains an inert inlay, internals, and the electrode arrangement. Convective mixing was accomplished by means of a magnetically coupled stirrer at a constant distance below the cathode.

In order to perform electrochemical reactions under pressure, it is necessary to integrate the electrode arrangement into a pressure-rated vessel made of a mechanically solid material stainless steel for example, which, however, by virtue of its inert conductivity, must not have any contact at all with the electrodes or with the electrode medium; this has been accomplished by the stated inlay. Particularly advisable in this context is the use of highly corrosion-resistant stainless steels such as 1.4435 or 1.4462. In the case of stainless steels such as 1.4301 or 1.4306, a high tendency toward chemical corrosion has been recorded, due to unavoidable droplets of electrolyte. It is, however, possible for the parts affected to be partitioned off with internals made of PEEK, Teflon or another material with sufficient mechanical stability and chemical inertness.

An insert made of PTFE (Teflon) and a lid of PEEK, with corresponding passages for the feedlines and electrodes, enables extensive electrical insulation of the functional elements. The arrangement composed of inlay, internals and electrodes was introduced during the reaction into the PTFE insert described, and the reactor was completely closed. Electrically insulated contacts then enable a voltage to be applied to the electrodes through the pressure-stable stainless steel jacket.

Description of the Experimental Investigation

Prior to each experiment, a pre-prepared Ni electrode 1 was inserted into the electrode arrangement; the Luggin capillary 3 was provided with 1-molar TBAB-DMF solution, the reactor was assembled accordingly, and a magnetic stirring core was provided. A number of evaluation cycles with repeated nitrogen venting made it possible to eliminate humid air, oxygen and any solvent residues from preceding cleaning steps.

The reactor was subsequently charged with the corresponding target pressure in the form of a pre-prepared $CO_2/H_2$ mixture. The reaction medium, an aprotic, anhydrous organic solvent with a conductive salt soluble therein, was added via a metering system comprising a high-pressure pump, an expansion unit and a mixer. During this time, a specific amount of 1,3-butadiene is metered in precisely.

After the end of the metering process to the target volume of reaction material in the reactor, there was an equilibration phase of around 30 minutes, for the complete saturation of the reaction material with $CO_2$ and $H_2$. Mixing was ensured by magnetically coupled stirring with the magnetic stirring core. The pressure was held at the target pressure by closed-loop control automatically.

In order to ensure continually identical reaction conditions, a computer-controlled standard procedure was used for all the reactions, comprising electrode activation cycles, the reaction itself, and further electrochemical characterization steps.

After each reaction run, the reactor was slowly let down according to an automated standard procedure and the reaction chamber in the closed condition was purged for about an hour with a slight nitrogen overpressure in order reliably to remove the escaping 1,3-butadiene. The reaction material withdrawn was concentrated to dryness on a rotary evaporator.

Product analyses were carried out by gas chromatography or attached mass spectroscopy (GC/MS). For this purpose, a sample of the crude product material was subjected to quantitative silylation and measured against standards. A number of isomers of the byproducts could be identified here merely from the basis of indications. The dried product was subsequently analyzed for the organic carbon content (TOC, total organic carbon). The purpose of this was to enable a conclusion regarding an inhibitory effect on the polymerization by the mediators. For this purpose the product was completely dissolved and subjected to measurement by inclination with subsequent IR spectroscopy of the gas phase.

The product composition was then determined by GC/MS. A consistency test was carried out using a number of individual samples from one reaction run, multiple determination of the samples, and also a separate analysis of the total amount of coupling products by HPLC/DAD/ELSD (High performance liquid chromatography (HPLC), Diode array detector (DAD), Evaporative light scattering detector (ELSD)).

In preparation for the reaction runs, the organic solvent to be used was dewatered over a drying agent, phosphorus pentoxide or sodium hydride, for example, and subjected to vacuum distillation. Under an argon atmosphere, the dried solvent was added to predried conductive salt and stored over freshly baked molecular sieve (4 Å).

There are a number of solvents suitable for the intended reactions: dimethylformamide (DMF), dimethylpropyleneurea (DMPU) and N-methyl-2-pyrrolidone (NMP); primarily, however, DMF was used, owing to its good results. The conductive salt used was, in particular, tetra-n-butylammonium bromide (TBAB).

For the preparation of the working electrode, nickel sheets were first sawn to size and ground to shape. The resulting plate was mounted onto a corresponding holder by TIG welding, avoiding extraneous metal contamination. The electrode underwent consecutive grinding, polishing, washing and drying steps until in the ready-to-use state. Micrographs (AFM) of the fully prepared electrode show the working electrode to have an initial peak-to-value roughness of 68 nm.

The counterelectrode used was either a platinum coil or a platinum plate, and was first cleaned and then brought into shape. All of the electrodes, moreover, were electrically insulated with Teflon sleeves on those parts not intended for exposure to the electrolyte.

Prior to each experiment, the Teflon reactor insert was rinsed with aqua regia, cleaned thoroughly and then dried.

The working electrode and counterelectrode were pretreated as described and inserted into the reactor. The reference electrode bridge (Luggin capillary) was prepared and filled with electrolyte, and then inserted into the reactor insert, and the reactor was then closed. After the contacts had been checked for short circuits or inadequate electrical resistances, the reactor was charged via the metering system with a specific amount of electrolyte solution and 1,3-butadiene. In each experiment the total volume of electrolyte and 1,3-butadiene was 28.00 ml.

In order to ensure gas supply during the reaction, a gas mixture of hydrogen and carbon dioxide in the target composition was prepared in a pressure-stable reservoir vessel (500 ml).

xantphos are comparable (TOC), but the second shows the higher Faraday efficiency overall. When ferrocene is used, there is no inhibitory effect in relation to the Faraday efficiency with regard to the target product.

TABLE 1

| Results | | | | | | | |
|---|---|---|---|---|---|---|---|
| Variables | | | | Addition | Calculated values | | |
| $c_{0,Bu}/\frac{mol}{l}$ [1] | $P_g$/M Pa[2] | $Q_n$/As[3] | $[J_a]/\frac{mA}{cm^2}$ [4] | Mediator | FE/%[5] | $FE_n$/%[6] | $FE_m$/%[7] |
| 1.62[x] | 3.4 | 2193 | 10 | — | 14.8 | 6.3 | 2.3 |
| 1.62[x] | 3.4 | 2193 | 10 | — | 20.0 | 13.3 | 1.7 |
| 1.62[a] | 3.4 | 2193 | 10 | $RhCl(COD)_2$, XP | 22.0 | 11.1 | 1.9 |
| 1.62[b] | 3.4 | 2193 | 10 | $PdCl_2$, XP | 29.5 | 14.4 | 2.1 |
| 1.62[c] | 3.4 | 2193 | 10 | $PdCl_3$, XP | 21.0 | 11.8 | 2.4 |
| 1.62[d] | 3.4 | 2193 | 10 | Fc | 34.7 | 17.3 | 4.7 |
| 1.62[e] | 3.4 | 2193 | 10 | Fc | 51.8 | 26.2 | 5.2 |

[x]Without use of mediators
[a]Addition of $RhCl(CO)_3$ (50 μmol) and xantphos (60 μmol)
[b]Addition of $PdCl_2$ (50 μmol) and xantphos (60 μmol)
[c]Additon of $RuCl_3$ (50 μmol) and xantphos (60 μmol)
[d]Addition of ferrocene (134 μmol)
[e]Addition of ferrocene (670 μmol)
[1]Initial concentration, 1,3-butadiene
[2]Prevailing overall pressure of the gas mixture
[3]Integrally transferred charge amount during the reaction
[4]Mean current density, with homogeneous electric field assumed
[5]Faraday efficiency of the sum total of all the electrode dicarboxylation products
[6]Faraday efficiency of the sum total of all components which can be utililized in the production of adipic acid
[7]Faraday efficient of monocarboxylic acid During the reactions presented here, the partial pressures were as follows: $p_0(H_2)$=1.0 MPa and $p_0(CO_2)$=3.0 MPa. The reactor was charged via a pressure regulator with a pressure of p=3.4 MPa, which was maintained for a saturation period of 30 minutes. The voltage was then regulated over the reaction time so as to maintain a current of −50 mA±0.1 mA. The reaction time was a constant 43 857 seconds, with a corresponding charge amount of 2193 As. With the 50 mA current used, the electrode area of 5 $cm^2$ meant that the current density j was 10 $mA/cm^2$.

Provided below are a number of examples on the feasibility of the reaction in a pressure vessel using a predefined amount of 1,3-butadiene.

Figure 2:
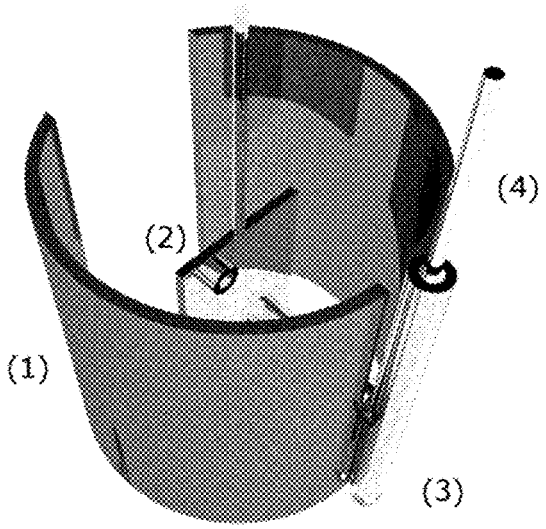
FIG. 2 shows a schematic view of a second embodiment of an electrode arrangement (concentric arrangement).

The electrode arrangements used for these reactions are shown in FIGS. 1 and 2. FIG. 1 shows a parallel arrangement with Pt coil 1 as anode, polished Ni plate 2 as cathode, Luggin capillary with frit 3, and silver-silver bromide electrode 4. FIG. 2 shows a concentric arrangement with Pt plate 1 as anode, polished Ni plate 2 as cathode, Luggin capillary with frit 3, and $Ag/Ag^+$ electrode 4.

The Faraday efficiencies determined for the reaction runs are contained in table 1. The first entry in table 1 describes the plane-parallel construction, while the second entry shows the concentric construction. All of the experiments with additions were performed in the concentric construction.

As likewise can be seen from table 1, the additions (mediators) used enable a considerable increase to be achieved in the Faraday efficiencies. In case of ferrocene, up to 51.8%; when using $PdCl_2$ in conjunction with xantphos, 29.5%. In the latter case, surprisingly, a reduction is observed in the polymerization tendency of 1,3-butadiene. The inhibitory effects in relation to polymerization of $RhCl_3$ in conjunction with xantphos and $PdCl_2$ in conjunction with The product spectrum in the reaction runs embraces a series of different dicarboxylation products and is set out in table 2.

TABLE 2

| Analysis of the product phase | | |
|---|---|---|
| Substance | Significance | Note |
| (E)-2-Hexenedioic acid | high | main product |
| (Z)-2-Hexanedioic acid | low | main product |
| (E)-3-Hexenedioic acid | high | main product |
| (Z)-3-Hexenedioic acid | low | main product |
| (E) 3-Methyl-pentenedioic acid | high | byproduct |
| (Z)-3-Methyl-pentenedioic acid | low | byproduct |
| Pentanedioic acid | low | critical byproduct |
| Pentanedioic acid | low | critical byproduct |
| 1,8-Octanedioic acid | traces | byproduct |
| Ethandioic acid | traces | byproduct |

The results set out in table 2 show that a higher $CO_2$ partial pressure is necessary in order to achieve a considerable increase (from 3.8% to 20%) in the very limited Faraday efficiency of the electrodicarboxylation of Grinberg et al.

It was additionally possible to demonstrate that the monocarboxylic acid (4-pentenoic acid), which is a considerable disruptor to the polymerization process of adipic acid with adiponitrile to form nylon, as a result of termination, could be very largely avoided when using appropriately high $CO_2$ partial pressures and sufficiently high current densities (10 $mA/cm^2$).

Furthermore, a strong influence of the electrode arrangement on the selectivity was ascertained. Examples 1 and 2 served for this purpose. There was increased formation of branched products when a parallel arrangement was utilized.

A concentric electrode arrangement greatly reduced the formation of the unwanted methyl-pentenedioic acid derivative.

The invention claimed is:

1. A process for electrodicarboxylation of at least one diene, with carbon dioxide $CO_2$ in the presence of hydrogen $H_2$ to form at least one unsaturated dicarboxylic acid, comprising:

carrying out a reaction in a reactor, wherein the reaction is the electrodicarboxylation of the at least one diene, with the carbon dioxide $CO_2$ in the presence of the hydrogen $H_2$ to form the at least one unsaturated dicarboxylic acid, wherein:

at least one cathode as working electrode for a cathodic activation of the carbon dioxide $CO_2$, and at least one anode as counter electrode for a anodic oxidation of the hydrogen $H_2$, wherein:

a volumetric ratio of the hydrogen $H_2$ to the carbon dioxide $CO_2$ is between 1:1 and 1:3;

a total pressure $p_g$ in the reactor is between 2 and 4 MPa, wherein the carbon dioxide is present in the reactor with a partial pressure $p_{0,CO2}$ of between 2 and 4 MPa and the hydrogen $H_2$ is present in the reactor with a partial pressure $p_{0,H2}$ of between 0.75 and 2 MPa; and a mean current density j is between 5 and 15 mA/cm$^2$.

2. The process as claimed in claim 1, wherein the hydrogen $H_2$ is present in the reactor with a partial pressure $p_{0,H2}$ of between 1 and 1.5 MPa.

3. The process as claimed in claim 2, wherein the at least one diene is metered in liquid form into the reactor.

4. The process as claimed in claim 2, wherein the carbon dioxide $CO_2$ is present in the reactor with a partial pressure $p_{0,CO2}$ of between 3 and 4 MPa.

5. The process as claimed in claim 4, wherein the at least one diene is metered in liquid form into the reactor.

6. The process as claimed in claim 2, wherein the at least one diene is a linear conjugated diene.

7. The process as claimed in claim 1, wherein the carbon dioxide $CO_2$ is present in the reactor with a partial pressure $p_{0,CO2}$ of between 3 and 4 MPa.

8. The process as claimed in claim 7, wherein the at least one diene is metered in liquid form into the reactor.

9. The process as claimed in claim 1, wherein the at least one diene is metered in liquid form into the reactor.

10. The process as claimed in claim 1, wherein the at least one diene is a linear conjugated diene.

11. The process as claimed in claim 1, further comprising increasing a Faraday efficiency, wherein the Faraday efficiency for a sum total of all dicarboxylation products is 15-30%.

12. The process as claimed in claim 1, further comprising increasing a Faraday efficiency, wherein the Faraday efficiency for a sum total of all dicarboxylation products which can be used for preparing linear, unbranched dicarboxylic acids is 10-25%.

13. The process as claimed in claim 1, wherein the reaction is performed in a dried organic solvent comprising at least one conductive salt.

14. The process as claimed in claim 13, wherein the dried organic solvent is selected from:

dimethylformamide (DMF);

dimethylpropyleneurea (DMPU); and

N-methyl-2-pyrrolidone (NMP).

15. The process as claimed in claim 14, wherein the organic solvent is DMF.

16. The process as claimed in claim 13, wherein the at least one conductive salt is an alkylammonium bromide.

17. The process as claimed in claim 1, wherein the reaction is performed in the presence of a mediator.

18. The process as claimed in claim 17, wherein the mediator is a transition metal complex.

* * * * *